US006506063B1

(12) United States Patent
Moriwake et al.

(10) Patent No.: US 6,506,063 B1
(45) Date of Patent: Jan. 14, 2003

(54) PIN HEADER AND A METHOD OF MAKING SAME

(75) Inventors: Ryo Moriwake, Izumiotsu (JP); Hideaki Horiuchi, Suita (JP)

(73) Assignee: J.S.T. Mfg. Co., Ltd., Osaka (JP)

( * ) Notice: Subject to any disclaimer, the term of this patent is extended or adjusted under 35 U.S.C. 154(b) by 62 days.

(21) Appl. No.: 09/655,875

(22) Filed: Sep. 6, 2000

(30) Foreign Application Priority Data

Sep. 8, 1999 (JP) ..... 11-253822

(51) Int. Cl.[7] ..... H01R 9/09
(52) U.S. Cl. ..... 439/79
(58) Field of Search ..... 439/79; 29/883, 29/889, 874

(56) References Cited

U.S. PATENT DOCUMENTS 4,802,860 A * 2/1989 Kikuta ..... 439/79
5,971,775 A * 10/1999 Tor et al. ..... 439/79

* cited by examiner

*Primary Examiner*—Renee Luebke
*Assistant Examiner*—Phuong Chi Nguyen
(74) *Attorney, Agent, or Firm*—Antonelli, Terry, Stout & Kraus, LLP

(57) ABSTRACT

A pin header has pin contacts (12)(12A, 12B) insert-molded in a parallelepiped insulating housing (13), and penetrating it to form upper and lower rows. Each contact is integrally composed of a plugging rod (14) extending horizontally and forwardly of the housing, a leg (15)(15A, 15B) and a generally straight rearward extension (16). The rod (14) has a rear end exposed rearward from the housing and bent downward and rectangularly to provide the leg. Each leg has its lower end continuing to the extension (16) to be surface-mounted on a printed circuit board. Only the legs (15A) from upper row have each an intermediate step (19) between it and the extension, this step formed by rectangularly bending each leg outwardly at first and then downwardly. These legs (15A) are embedded in the housing (13), with those steps (19) being exposed together with extensions (16). The upper contacts will not unintentionally move when insert molding the housing, protecting it from warping, improving coplanarity of extensions, and rendering the rods (14) resistant to torsion or a bending stress, thereby enabling manufacture of thinned pin headers.

3 Claims, 7 Drawing Sheets

PIN HEADER AND A METHOD OF MAKING SAME

FIELD OF THE INVENTION

The present invention relates to a pin header designed to be surface mounted on a printed circuit board, and more particularly to a pin header comprising a plurality of pin contacts that are arranged in parallel upper and lower rows and through an insulating housing. The invention further relates to a method of making this type of pin header, wherein the housing is of a rectangular parallelepiped shape and insert-molded using the pin contacts that serve as inserts to be embedded in the molded housing.

BACKGROUND OF THE INVENTION

FIGS. 8 and 9 show an example of the prior art pin header 1. This pin header has a plurality of pin contacts 2 that form upper and lower rows in an insulating housing 3. The housing is generally of a parallelepiped shape and insert-molded with the plurality of pin contacts 2 each penetrating it. Each pin contact 2 is composed of a plugging rod 4 extending horizontally, a leg 5A or 5B and a generally straight and horizontal extension 6, all integral with each other. The plugging rod 4 protruding from a front face 3*a* of the housing 3 has a rear end that is exposed on a rear face of this housing. The rear end is bent downwards generally at a right angle to provide the leg 5A or 5B. Each leg has its lower end continuing at a right angle to the horizontal and straight extension 6 that is to be surface-mounted on a printed circuit board 'P'. Those legs 5A, which the pin contacts 2A forming the upper row near the upper face of the housing 3 do have, are much longer than the other legs 5B which the other contacts 2B forming the lower row have. As will be seen in FIGS. 10 and 11, formed in the rear end of each plugging rod 4 is such a shoulder 7 as thinning a rearward region of each contact 2A and 2B. Thus, each leg 5A and 5B as well as each rear straight extension 6 are made thinner than the body of each plugging rod. A crosspiece 8 formed integral with rearward ends of the extensions 6 holds the upper or lower contacts 2A and 2B at a regular pitch while insert molding them in the housing 3, until being subsequently cut off to provide a finished product.

The insert molding of the housing 3 with upper and lower contacts 2A and 2B will be carried out as shown in FIG. 12, wherein each upper contact 2A with a longer leg 5A is retained at three pints. In detail, a mold segment 'K' holds therein the contact's plugging rod 4, whilst other segments 'L' and 'M' grip the rod's rear end 4', with the segment 'L' and another segment 'N' griping the crosspiece 8. Due to a considerably long distance from the rear ends 4' to the common crosspiece, the upper contacts have been likely to make unintentional movement within the mold. Consequent distortion of the housing 3 in position as a whole has adversely affected 'coplanarity' of the straight extensions 6 affixed to the circuit board. If thickness 'S' of the housing 3 were reduced in a fore and aft direction to provide a thinnest possible pin header 1, then this problem would be more serious. Such a reduced thickness 'S' has caused another problem that the housing 3 could not surely hold the pin contacts 2, failing to protect their shoulders 7 from breakage against torsion or a bending stress imparted to the rods 4 when plugging them in sockets.

SUMMARY OF THE INVENTION

An object of the present invention made in view of such drawbacks is therefore to provide an improved pin header and a method of making same, wherein contacts forming an upper row do scarcely make any unintentional movement while being insert molded and the resultant pin header is protected in its entirety from positional distortion. Another object is to provide a pin header that does not only ensure 'coplanarity' of its rear, horizontal and straight extensions but also have plugging rods resistant to torsion or a bending stress, so that the pin header can be made thinner in dimension.

To achieve these objects, a pin header provided herein has a plurality of pin contacts forming upper and lower rows in an insulating housing. The housing is generally of a parallelepiped shape and insert-molded with the pin contacts each penetrating it. Each pin contact is composed of a plugging rod extending horizontally, a leg and a generally straight and horizontal extension, all integral with each other. The plugging rod protruding from a front face of the housing has a rear end that is exposed on a rear face of this housing, with the rear end being bent downwards generally at a right angle to provide the leg. Each leg has its lower end continuing at a right angle either directly or indirectly to the rearward, horizontal and straight extension that is to be surface-mounted on a printed circuit board. Characteristically, only those legs of the pin contacts forming the upper row in the housing have each an intermediate step (19) at a corner between the leg and the horizontal extension. The intermediate step is formed by twice-bending each leg outwardly at first at a right angle and then downwards also at a right angle. Thus, the legs of the pin contacts forming the upper row are embedded in the housing, with the intermediate step of each contact being exposed outside together with the rearward horizontal extenion.

Preferably, a shoulder may be formed in a middle region of the leg so as to render each leg and each rear straight extension thinner than the body of each plugging rod.

A method provided herein for manufacturing the pin header just summarized does comprise the step of preparing pin contacts whose rear horizontal and straight extensions to be surface-mounted on a printed circuit board are arranged at a predetermined pitch and in parallel with each other and are integrally connected to a common crosspiece. The method further comprises the steps of setting the pin contacts in an injection mold so as to form therein an upper row and a lower row, and finally insert-molding an insulating housing so that plugging rods of the contacts continue from respective legs and protrude forwardly of the housing, with the rear extensions continuing from the legs and protruding rearwardly of said housing. Characteristic to this method are the following features that the contacts forming the upper row in the housing do have each an intermediate step (19) at a corner between the leg and the horizontal extension, where in the intermediate step is formed by twice-bending each leg outwardly at first at a right angle and then downwards also at a right angle, and that during the step of insert molding the housing each contact forming the upper row is kept supported at four points in and by the mold, that is, at its plugging rod, at its rear surface area of the leg, at its intermediate step and at the cross-piece. Therefore, the entirety of each leg except for its rear surface area supported on a portion of the mold is embedded in the insulating housing thus molded.

THE PREFERRED EMBODIMENTS

Figure 1:
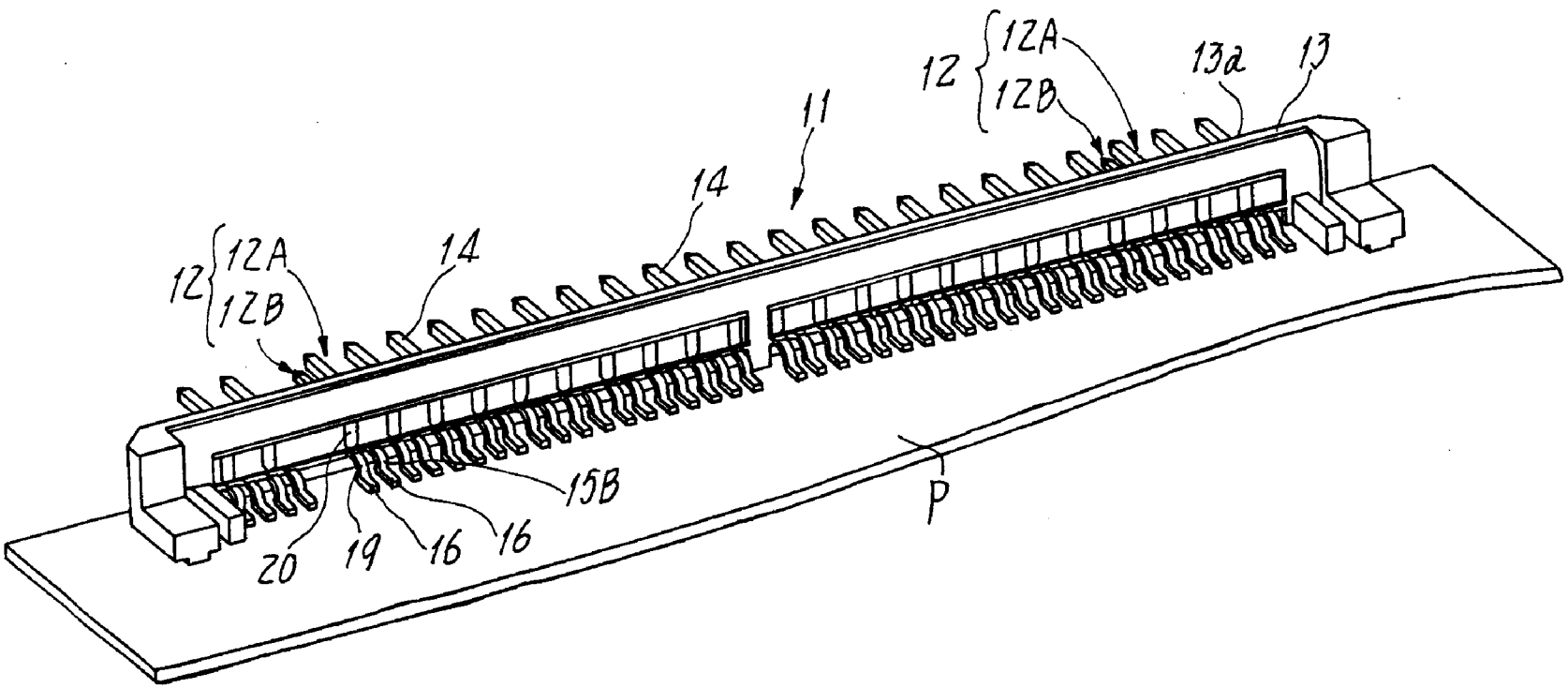
FIG. 1 is a rear perspective view of a pin header provided in accordance with the present invention.

Now, some preferable embodiments of the present invention will be described below referring to the drawings.

Figure 2:
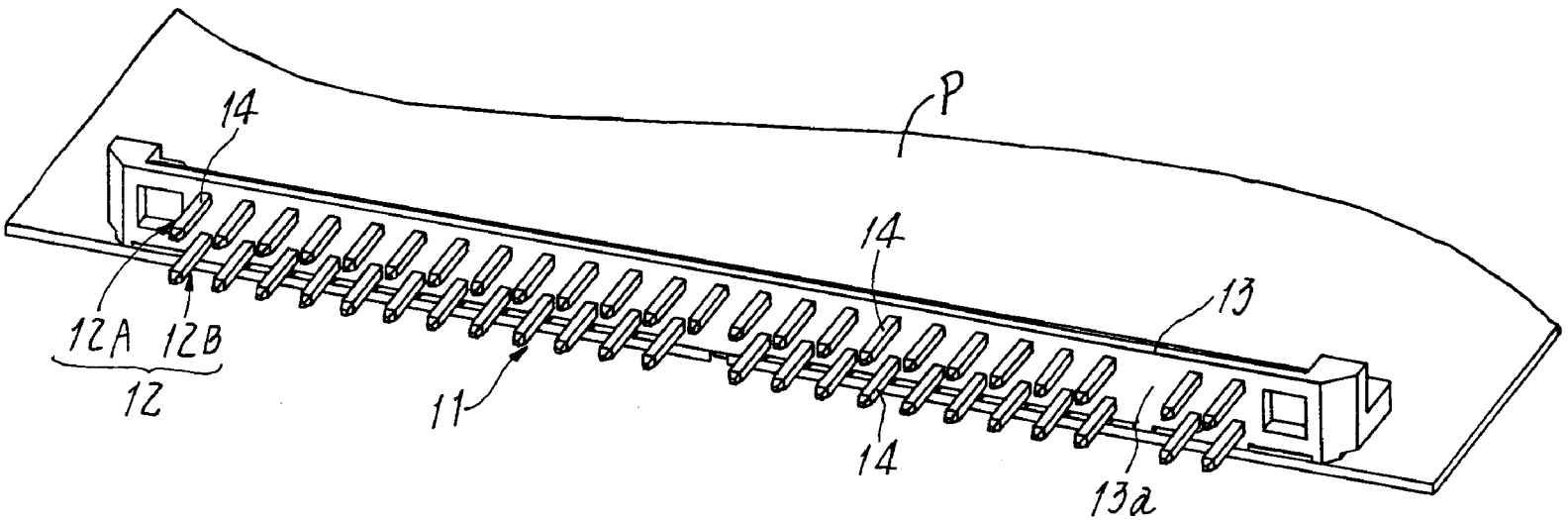
FIG. 2 is a frontal perspective view of a pin header.

FIGS. 1 and 2 show a pin header 11 of the present invention. A plurality of pin contacts 12 constituting this header are arranged in and through an insulating housing 13. This housing of a parallelepiped shape is insert-molded, with those pin contacts being previously set in place to form an upper row and a lower row prior to the molding of said housing. Each pin contact 12 is composed of a plugging rod 14, a leg 15 and a straight extension 16. The plugging rod 14 to be plug in a mating socket (not shown) protrudes from a frontal face 13*a* of the housing 13. The plugging rod has a rear end protruding rearwardly of the housing, with this rear end being bent downwards generally at a right angle to provide the leg 15 (see FIGS. 3 and 4). This leg has a lower end bent outwards also generally at a right angle so as to provide the straight extension 16 extending horizontally to be surface mounted on a printed circuit board "P". Similarly to the prior art pin header shown in FIGS. 8 to 11, each upper contact 12A included in the upper row in the housing 13 has its leg 15A longer than that 15B of each lower contact 12B. The rear ends of the horizontal extensions 16 are integral with a common crosspiece 18.

Figure 3:
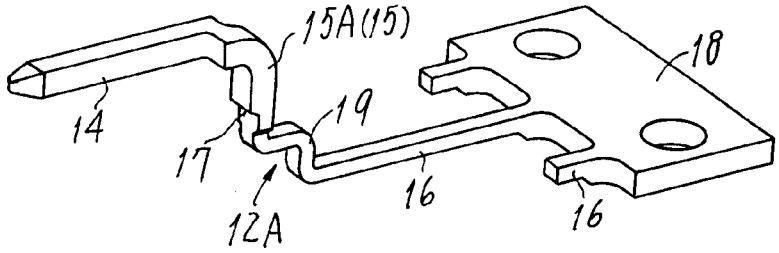
FIG. 3 is a perspective view of one of pin contacts forming an upper row in the pin header.
Figure 4:
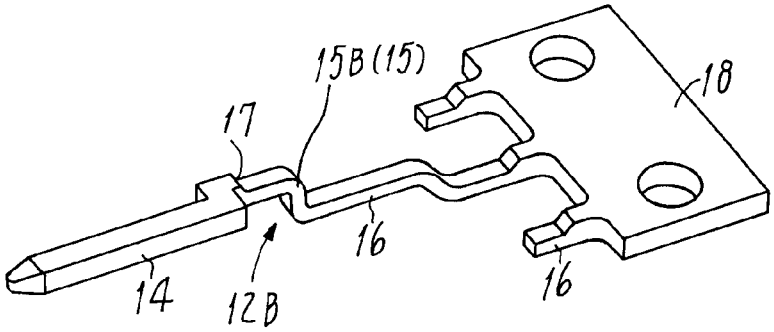
FIG. 4 is a perspective view of one of the other pin contacts forming a lower row in the pin header.

However, each upper pin contact 12A in the present invention has characteristically an intermediate step 19, as best seen in FIG. 3. This step 19 located at a corner between the leg 15A and the rear extension 16 is formed by bending the leg 1 SA outwards generally at a right angle so as to have an outer end, and further bending downwards this outer end also generally at a right angle. Such an intermediate step 19 is of a shape similar to or corresponding to the leg 15B of the lower pin contact 12B. A shoulder 17 is formed at a middle height of the leg 15A so as to render its lower portion and the extension 16 relatively thinner than the body of plugging rod. Thus, an upper portion of the leg 15A continuing downwards from the plugging rod 14 and located above said shoulder 17 is of the same thickness as that of said rod.

Figure 5:
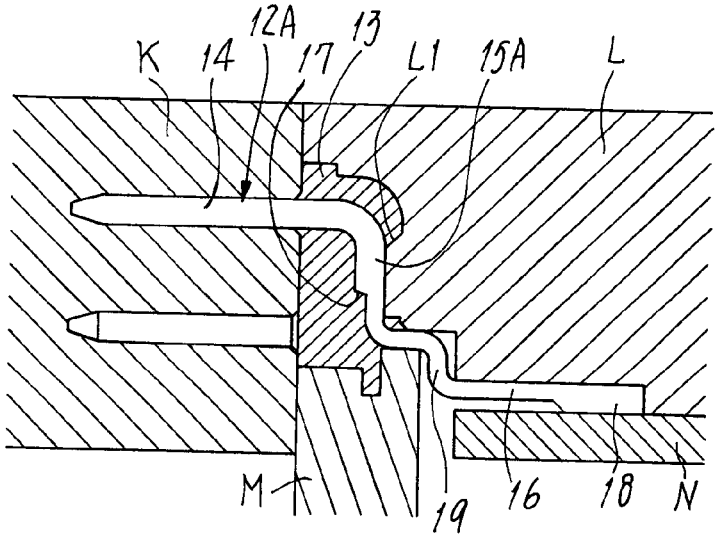
FIG. 5 is a vertical cross section of a mold used in an embodiment to insert-mold an insulating housing in which the upper pin contact of the pin header has been placed.

FIG. 5 shows how to insert mold the housing 13 in which the upper contact 12A has previously been placed. A mold segment 'K' supports the plugging rod 14, and further mold segments 'L' and 'M' grip the intermediate step 19 between them. The crosspiece 18 is gripped by and between one of the further segment 'L' and a still further segment 'N', so as to hold the upper contact 12A at three points. Additionally, a rear surface area of the leg 15A bears against a rib 'L1' of the further segment 'L', thereby affording four-point support for said contact 12A. After setting the contact in the mold in this manner, a resin will be injected into a cavity appearing between the mold segments 'K', 'L' and 'M' so as to form the housing 13. By insert molding the housing, the leg 15A will also be embedded in the resin, except for its rear surface area contacting the segment's rib 'LI'. As a result, such rear surface areas of the legs 15A will be exposed outsides, forming a plurality of elongate groove-shaped openings 20 in the rear face of the housing 13. On the other hand, the intermediate steps 19 will protrude rearwardly from the housing 13, together with the straight horizontal extensions 16.

Figure 6:
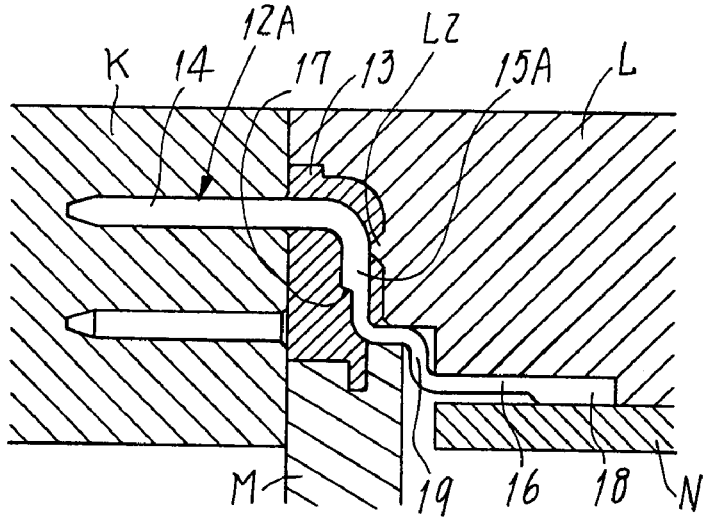
FIG. 6 also is a vertical cross section of the mold used in another embodiment for the same purpose.

FIG. 6 shows a modified embodiment wherein the rear surface area of each leg 15A is kept in a pointed contact with a lug 'L2' of the mold segment 'L' while insert molding the upper contacts 12A. This structure of the mold will almost completely embed each leg 15A in the housing 13.

Figure 7:
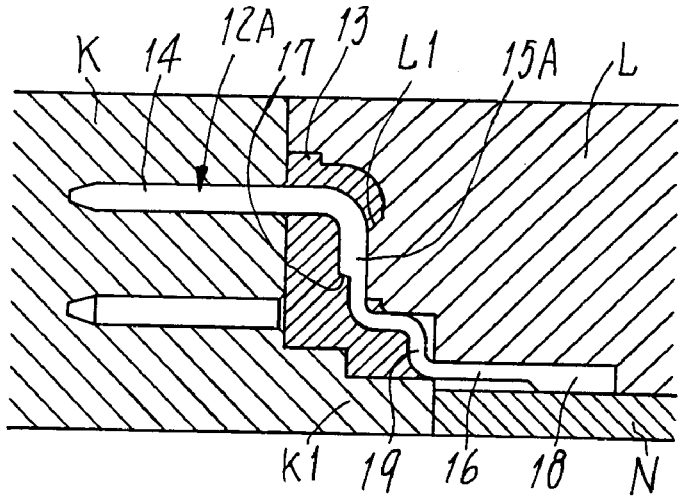
FIG. 7 is likewise a vertical cross section of the mold used in still another embodiment for the same purpose.
Figure 8:
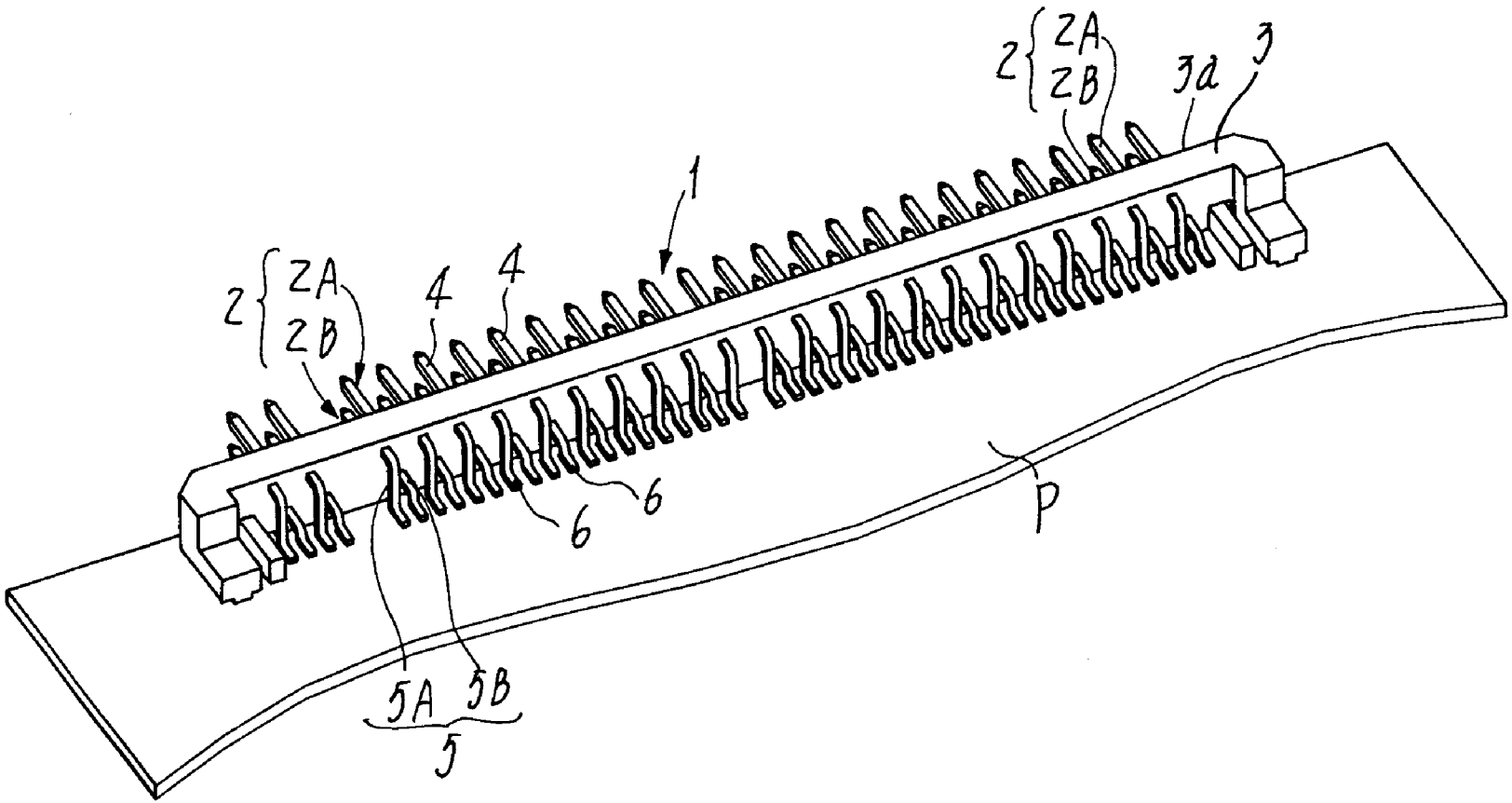
Fig.8 Prior Art
FIG. 8 is a rear perspective view of the prior art pin header.
Figure 9:
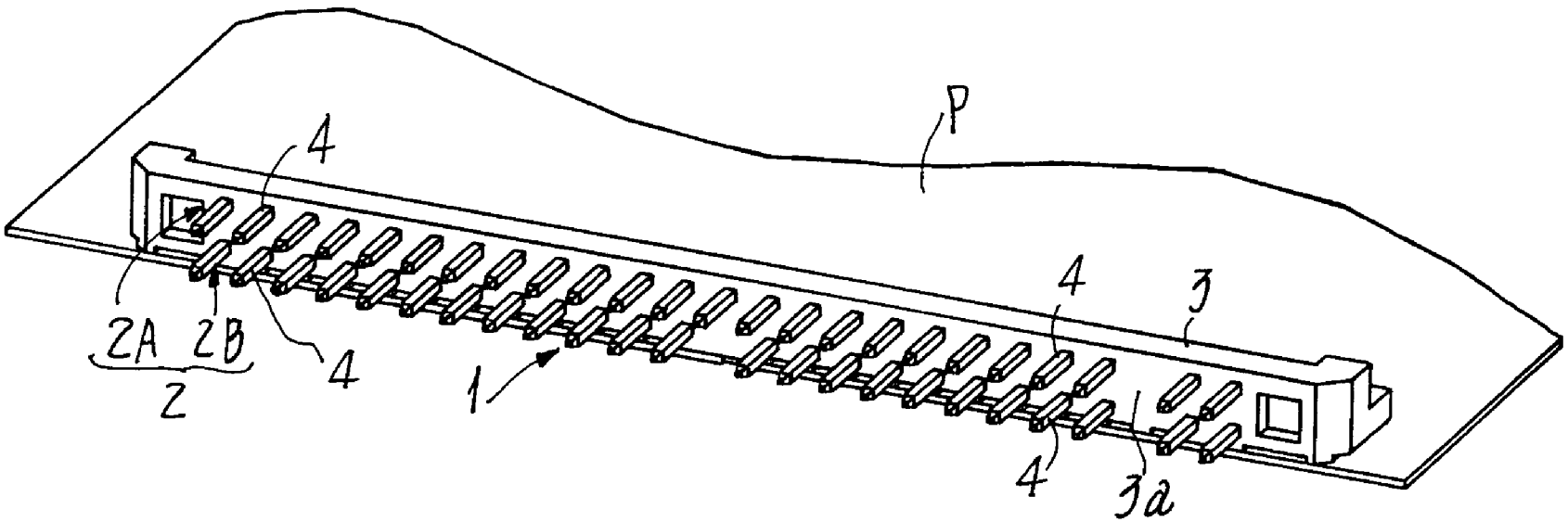
Fig.9 Prior Art
FIG. 9 is a frontal perspective view of the prior art pin header.
Figure 10:
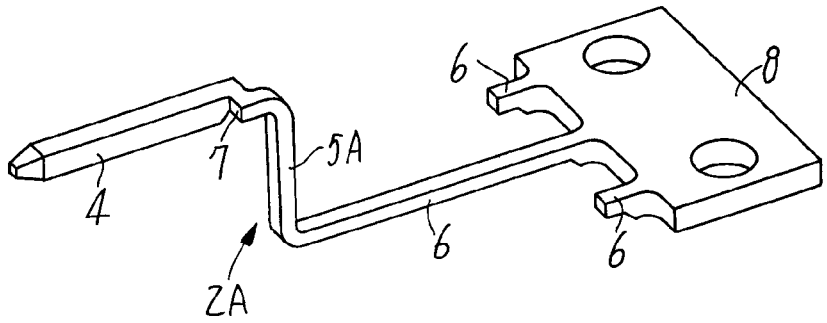
Fig.10 Prior Art
FIG. 10 is a perspective view of one of pi n contacts forming an upper row in the prior art pin header.
Figure 11:
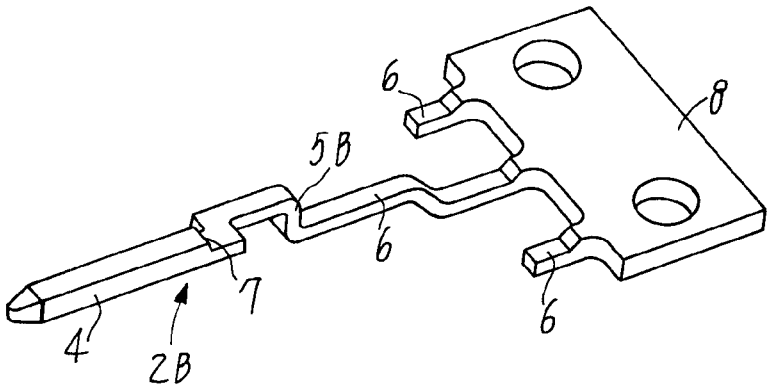
Fig.11 Prior Art
FIG. 11 is a perspective view of one of the other pin contacts forming a lower row in the prior art pin header.
Figure 12:
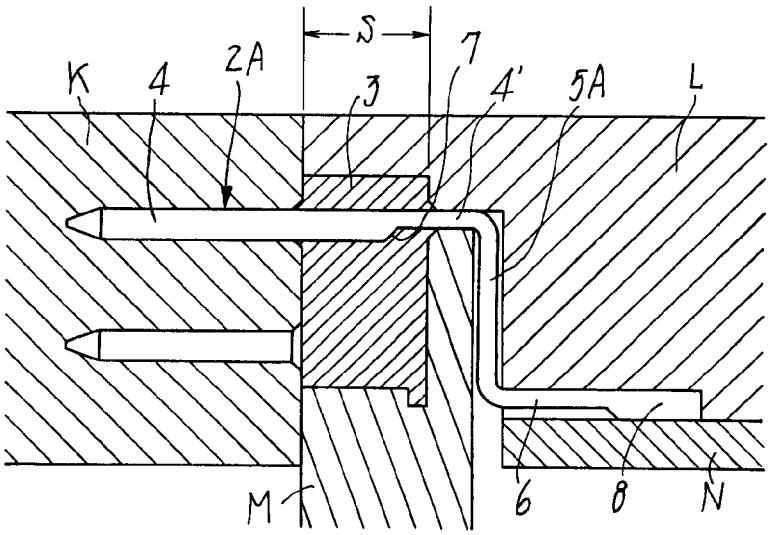
Fig.12 Prior Art
FIG. 12 is a vertical cross section of a mold used in the prior art to insert-mold an insulating housing in which the upper pin contact of the pin header has been placed.

FIG. 7 shows another embodiment wherein the embodiment shown in FIG. 6 is further modified such that the mold segment 'M' is dispensed with. In this case, an extension 'K1' from the segment 'K' cooperates with the segment 'L' to grip the intermediate steps 19. This mold will produce a housing 13 that supports also the lower portion of each intermediate step 19, hereby further enhancing protection of the legs 15A from unintentional movement.

Each lower pin contact 12B (see FIG. 4) has, similarly to the upper one 12A, a shoulder 17 disposed intermediate opposite ends of the leg 15B so as to improve resistance to torsion or bending stress. However, those contacts 12B are of almost the same configuration as the lower contacts 2B in the prior art, making useless any further discussion.

It will now be apparent that the pin header 11 of the present invention is insert molded while its upper contacts 12A are supported at four points within the assembly of mold segments 'K', 'L', 'M' and 'N'. Unintentional movement of each upper contact is now diminished during the step of insert molding the header, thereby surely protecting it from being warped and improving 'coplanarity' of the straight horizontal extensions 16. Each leg 15A is embedded in the housing 13 so that the housing can now hold the -plugging rods in place more firmly. Since the shoulder 17 for thinning the leg and extension is disposed intermediate the opposite ends of each leg 15A, the rod 14 will now be more resistant to torsion or a bending stress that is imparted to it when plugged into a mating socket. The housing 13 can now be successfully reduced in thickness in fore and aft direction to provide a thinner pin header 11, without impairing its 'coplanarity' and strength.

In summary, the pin header provided herein is advantageous in that the upper pin contacts are inhibited from making unintentional movement during the step of insert molding, whereby the housing is now prevented from becoming warped. Coplanarity of the straight extensions as well as torsion or bending strength of the plugging rods are now improved to enable manufacture of thinner pin headers.

The manufacturing method of the present inventions makes it easy to manufacture thinned pin headers.

What is claimed is:

1. A pin header comprising:

a plurality of pin contacts;

an insulating housing generally of a parallelepiped shape and insert-molded with the pin contacts each penetrating the housing;

the pin contacts forming an upper row and a lower row in the insulating housing;

each pin contact composed of a plugging rod extending horizontally from a front face of the housing, a leg and a generally straight, rearward and horizontal extension, all integral with each other;

the plugging rod protruding from the front face of the housing and having a rear end that is exposed on a rear face of the housing, with the rear end being bent downwards generally at a right angle to provide the leg; and each leg having its lower end continuing at a right angle either directly or indirectly to the rearward horizontal extension that is to be surface-mounted on a printed circuit board, wherein only those legs of the pin contacts forming the upper row in the housing have each an intermediate step at a corner between the leg and the horizontal extension, the intermediate step being formed by twice-bending each leg outwardly at first at a right angle and then downwards also at a right angle, and wherein the legs of the pin contacts forming the upper row are at least partially embedded in the housing, with the intermediate step of each contact being exposed outside together with the rearward horizontal extension.

2. A pin header as defined in claim 1, wherein each leg in the upper row has its rear surface area exposed outsides and rearwardly of the housing.

3. A pin header as defined in claim 1 or 2, wherein a shoulder is formed in a middle region of the leg so as to render each leg and each rear straight extension thinner than the body of each plugging rod.

* * * * *